US007017204B1

(12) United States Patent
Fertil et al.

(10) Patent No.: US 7,017,204 B1
(45) Date of Patent: Mar. 28, 2006

(54) ADJUSTABLY PARTITIONED CRIB

(76) Inventors: Marc Fertil, 1430 NW. 79 Ter., Pembroke Pines, FL (US) 33024; Berline Fertil, 1430 NW. 79 Ter., Pembroke Pines, FL (US) 33024

( * ) Notice: Subject to any disclaimer, the term of this patent is extended or adjusted under 35 U.S.C. 154(b) by 0 days.

(21) Appl. No.: 11/037,767

(22) Filed: Jan. 19, 2005

(51) Int. Cl.
*A47D 13/06* (2006.01)
*A47D 7/01* (2006.01)

(52) U.S. Cl. ..... 5/93.1; 5/513

(58) Field of Classification Search ..... 5/93.1, 5/513, 658, 2.1; D6/384, 390, 505, 508
See application file for complete search history.

(56) References Cited

U.S. PATENT DOCUMENTS

| | | | | | |
|---|---|---|---|---|---|
| 633,112 | A | * | 9/1899 | Bartlett | 5/498 |
| 1,092,298 | A | * | 4/1914 | Schwarz | 5/513 |
| 1,391,566 | A | * | 9/1921 | Musselman | 5/2.1 |
| 2,036,394 | A | * | 4/1936 | Butler | 5/513 |
| 2,109,267 | A | * | 2/1938 | Grosser | 5/2.1 |
| 2,242,357 | A | * | 5/1941 | Kroll et al. | 5/100 |
| D144,670 | S | * | 5/1946 | Adolf | D6/384 |
| 2,471,691 | A | | 5/1949 | Hurst | |
| 2,483,938 | A | * | 10/1949 | Royston | 5/93.1 |
| D156,678 | S | * | 12/1949 | Stettner | D6/384 |
| 2,659,904 | A | * | 11/1953 | McGinnis | 5/498 |
| 2,662,231 | A | * | 12/1953 | King | 5/2.1 |
| 2,686,922 | A | * | 8/1954 | La Vigne | 5/93.1 |
| 3,978,532 | A | * | 9/1976 | Scheiner | 5/93.1 |
| 4,178,926 | A | * | 12/1979 | Cohn | 5/513 |
| D277,157 | S | * | 1/1985 | Mower et al. | D6/506 |
| D278,398 | S | * | 4/1985 | Brunner et al. | D6/505 |
| D280,279 | S | * | 8/1985 | Brunner et al. | D6/508 |
| D287,681 | S | * | 1/1987 | Brunner et al. | D6/505 |
| 4,768,242 | A | * | 9/1988 | LoTurco | 5/93.1 |
| 4,890,346 | A | * | 1/1990 | Rist | 5/658 |
| 5,350,341 | A | * | 9/1994 | Wolscht | 482/35 |
| 5,787,524 | A | | 8/1998 | Butnik | |
| 5,926,870 | A | * | 7/1999 | Branca-Barnes et al. | 5/93.1 |
| 5,991,943 | A | * | 11/1999 | Morris | 5/93.1 |
| 6,189,165 | B1 | * | 2/2001 | Burton | 5/93.1 |
| 6,618,877 | B1 | * | 9/2003 | Stephen | 5/93.1 |

FOREIGN PATENT DOCUMENTS

| | | | |
|---|---|---|---|
| GB | 810258 | * | 3/1959 |
| GB | 2113987 A | * | 8/1983 |
| GB | 2309161 A | * | 7/1997 |

* cited by examiner

*Primary Examiner*—Robert G. Santos
(74) *Attorney, Agent, or Firm*—Crossley Patent Law; Mark A. Crossley

(57) ABSTRACT

An adjustably partitioned crib wherein at least one dividing rail is selectively and movably positioned between the two side rails, thereby dividing the crib into two separate areas for holding two infants. A further embodiment comprises two or more dividing rails for defining separated areas within the crib. Each adjustably positioned dividing rail is removably secured by locating pins with ball detent. A plurality of sliding drawers is affixed below the crib base.

3 Claims, 2 Drawing Sheets

ADJUSTABLY PARTITIONED CRIB

BACKGROUND OF THE INVENTION

1. Field of the Invention

The present invention relates to baby furniture and more specifically to an adjustably partitioned crib holding more than one infant.

2. Description of the Prior Art

Prior art teaches various styles and shapes of baby cribs. While some address the needs for holding more than one infant, they do so with design and function dissimilar to the present invention.

U.S. Pat. No. 5,787,524 issued to Butnik on Aug. 4, 1998 discloses a crib of unique shape, one that is capable of holding more than one infant.

The unique shapes offered by the device, though, are dissimilar from the design of the present invention, and the device does not offer the same adjustment mechanisms and capabilities of the present invention.

U.S. Pat. No. 2,471,691 issued to Hurst on May 31, 1949 discloses a crib wherein one of the vertical sides is horizontally adjustable. The crib does not focus on sleeping more than one child nor does it have the same adjustment design and mechanism of the present invention.

While the above-described devices fulfill their respective and particular objects and requirements, they do not describe an adjustably partitioned crib that provides for the advantages of the present invention, therefore, a need exists for an adjustably partitioned crib. In this respect, the present invention substantially departs from the conventional concepts and designs of the prior art.

SUMMARY OF THE INVENTION

In view of the foregoing disadvantages inherent in the known types of cribs now present in the prior art, the adjustably partitioned crib overcomes the above-mentioned disadvantages and drawbacks of the prior art.

As such, the general purpose of the adjustably partitioned crib, described subsequently in greater detail, is to provide an adjustably partitioned crib which has all of the advantages of the prior art mentioned heretofore and many novel features that result in an improved adjustably partitioned crib which is not anticipated, rendered obvious, suggested, or even implied by the prior art, either alone or in combination thereof.

To accomplish this, the adjustably partitioned parallelepiped crib comprises larger size than a typical crib. More than one size of adjustably partitioned crib is offered so that two infants or even more can be separately accommodated within the crib. The crib is formed from two opposing end rails meeting two opposing side rails, thereby forming 90 degree corners. Vertical members are equidistantly spaced through the end and side rails. Vertical members join the tops of the rails with the horizontal crib base, upon which the mattress rests. The ends of the outer vertical members comprising the end rails continue vertically downward from the intersection with the crib base thereby forming legs. Legs are preferably castered to aid in the mobility of the crib. The crib is unique in that it further comprises at least one dividing rail. The dividing rail resembles the side rails and end rails in that it also is comprised of equidistantly spaced vertical members. The dividing rail, though, is slightly shorter in overall height. The dividing rail thereby rests on top of the mattress. This feature allows the adjustably partitioned crib to preferably feature one mattress. While a varied embodiment offers separate mattresses for utilization within each selectively divided crib area, an individual mattress is preferred.

The top and outer ends of the dividing rails comprise hooks that fit over the end rail tops, further supporting the dividing rail. Further, the dividing rails have, in their end vertical columns at each end, dividing rail holes in the lower region. These holes selectively align with corresponding member orifices in the end rails' end vertical column. A locating pin is removably inserted through the member orifice, then through the dividing rail hole. The head of the pin abuts the outer end vertical column while the ball detent on the opposite end of the locating pin removably retains the pin in place, thereby securing the dividing rail in the chosen position. In this way, a single compartment crib is now a crib with two separate areas for two infants. A plurality of the end rail vertical columns is fitted with dividing rail holes so that the dividing rail can be positioned as desired. Additionally, further embodiments of the adjustably partitioned crib provide more than one dividing rail, thereby affording separate areas for more than two infants.

The basic design of the locating pins and dividing rail hooks provide for easy and rapid partitioning as desired. Where two or even more cribs would typically have to be purchased for two or more infants, the adjustably partitioned crib, instead, provides greater economy of space as well as greatly reduced expense in caring for multiple infants, or even in caring for infants and toddlers within the same crib. The adjustably partitioned crib is preferably made of wood or plastic, or even a combination thereof. Locating pins are preferably metal for greater durability. Mattresses are typical and are provided in typical sizes to match the various sized embodiments of the crib.

Varied embodiments of the adjustably partitioned crib offer solidly designed end rails and side rails, or even dividing rails, thereby negating the see-through design of the preferred embodiment. Still a further embodiment offers solid end rails, side rails, and solid dividing rails made of plexiglass or plastic, thereby affording solidity but see-through capability. A deluxe embodiment of the adjustably partitioned crib features drawers mounted below the crib base, the drawers for accessibly storing typical child care items and clothes and the like. Drawers are provided to slideably open from below the end rails or below the side rails.

Thus has been broadly outlined the more important features of the adjustably partitioned crib so that the detailed description thereof that follows may be better understood and in order that the present contribution to the art may be better appreciated.

Numerous objects, features and advantages of the adjustably partitioned crib will be readily apparent to those of ordinary skill in the art upon reading the following detailed description of presently preferred, but nonetheless illustrative, embodiments of the adjustably partitioned crib when taken in conjunction with the accompanying drawings. In this respect, before explaining the current embodiments of the adjustably partitioned crib in detail, it is to be understood that the invention is not limited in its application to the details of construction and arrangements of the components set forth in the following description or illustration. The invention is capable of other embodiments and of being practiced and carried out in various ways. It is also to be understood that the phraseology and terminology employed herein are for purposes of description and should not be regarded as limiting.

Those skilled in the art will appreciate that the conception upon which this disclosure is based may readily be utilized as a basis for the design of other structures, methods and systems for carrying out the several purposes of the adjustably partitioned crib. It is therefore important that the claims be regarded as including such equivalent constructions insofar as they do not depart from the spirit and scope of the present invention.

Objects of the adjustably partitioned crib, along with various novel features that characterize the invention are particularly pointed out in the claims forming a part of this disclosure. For better understanding of the adjustably partitioned crib, its operating advantages and specific objects attained by its uses, refer to the accompanying drawings and description.

DETAILED DESCRIPTION OF THE PREFERRED EMBODIMENT

Figure 1:
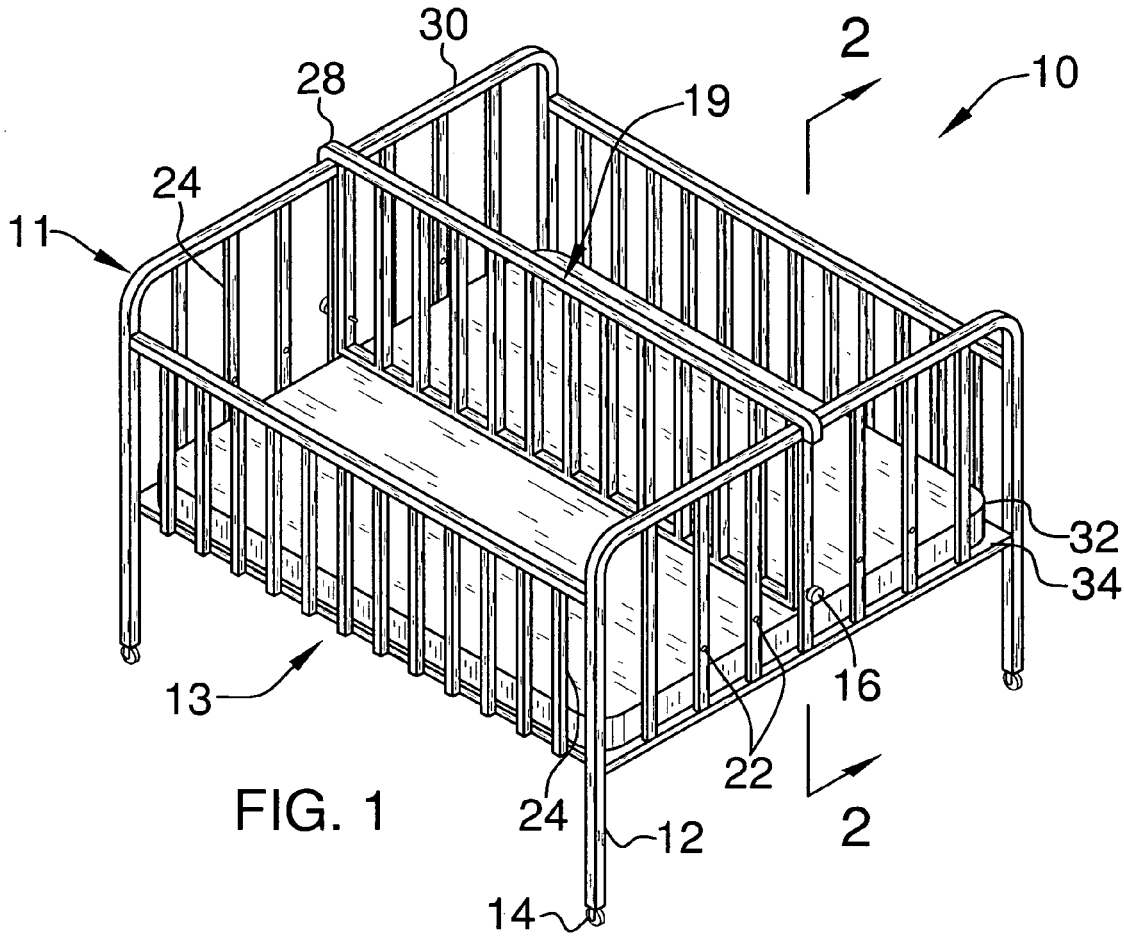
FIG. 1 is a perspective view of the adjustably partitioned crib.
Figure 2:
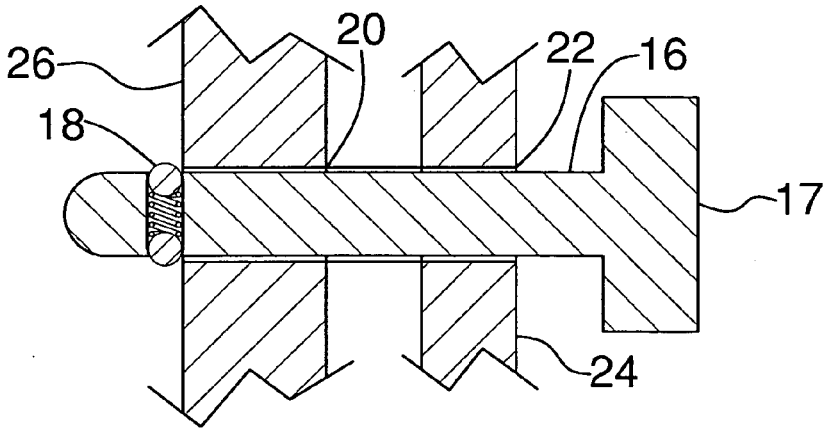
FIG. 2 is a cross sectional view of the locating pin inserted through the member orifice of the vertical member of the end rail and the dividing rail hole of the end vertical column of the dividing rail.
Figure 3:
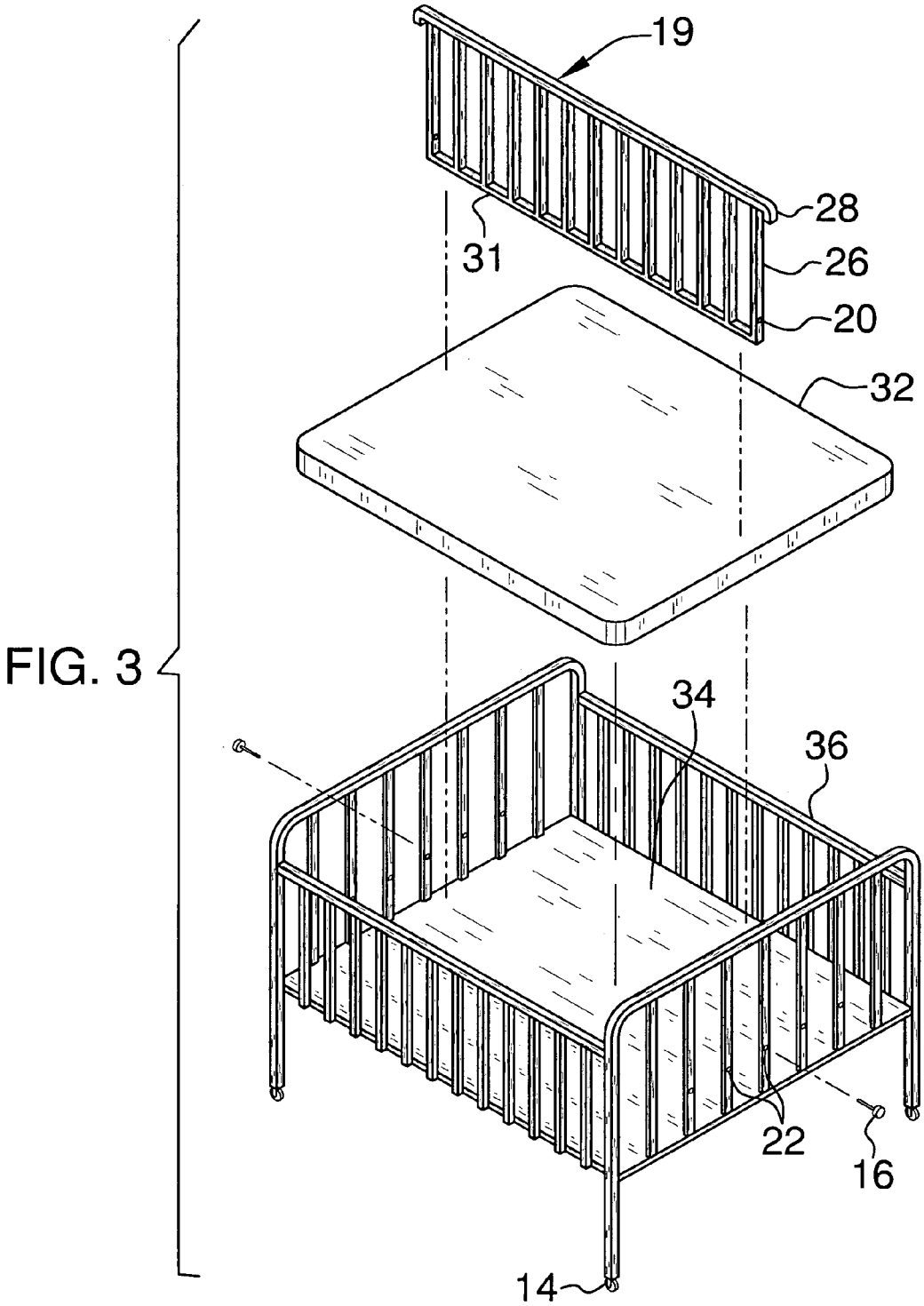
FIG. 3 is a perspective view of the partially disassembled adjustably partitioned crib.

With reference now to the drawings, and in particular FIGS. 1 through 3 thereof, the preferred embodiment of the adjustably partitioned crib employing the principles and concepts of the present invention and generally designated by the reference number 10 will be described.

Referring to FIGS. 1 and 3, the adjustably partitioned crib 10 comprises a parallelepiped rectangular shape formed by the corner junction of two opposing end rails 11 with two opposing side rails 13. End rail top 30 bends smoothly at each corner to progress vertically downward, continuing past the horizontal crib base 34 and therefrom forming legs 12. A caster 14 is fitted to the bottom of each leg 12 to aid in crib 10 mobility. Vertical members 24 are equidistantly spaced within the end rails 11, extending from an end rail top 30 downward to join the crib base 34. Vertical members 24 are joined to the crib base 34 at a perpendicular to the horizontal plane of crib base 34. Opposing side rails 13 connect the legs 12 of opposite end rails 11. Side rails 13 are fitted with equidistantly spaced vertical members 24. Vertical members 24 join the side rail tops 36 with crib base 34. The bottom of each side rail 13 is affixed to the crib base 34, the crib base 34 perpendicular to the vertical side rails 13. The crib base 34 is therefore supported in the horizontal plane by vertical side rails 13, legs 12, and vertical members 24. A mattress 32 removably rests atop base 34.

End rails 11 are further comprised of member orifices 22 in the lower region of a plurality of the vertical members 24 of the end rails 11. A dividing rail 19 removably and adjustably fits perpendicular to and between the two end rails 11. Dividing rail 19 is coplanar to side rails 13. Hooks 28 form a part of dividing rail 19 at the upper and outer edges. Hooks 28 loop over end rail tops 30 of end rails 11. An end vertical column 26 comprises each vertical end of the dividing rails 19. The dividing rail 19 is shorter than the end rails 11 and side rails 13 such that dividing rail 19 fits atop mattress 32. The end vertical columns 26 are further comprised of dividing rail holes 20 in a lower region of each end vertical column 26. Holes 20 correspond to member orifices 22. Locating pin 16 removably inserts through member orifices 22 and dividing rail holes 20 to secure the dividing rail 19 between and perpendicular to end rails 11. Pin 16 is comprised of a pin head 17 on one end and ball detent 18 on the other end (FIG. 2). Once inserted through member orifice 22 and dividing rail hole 20, pin 16 is selectively retained by the ball detent 18 and the pin head 17. Removal of pin 16 is by reverse procedure. Dividing rail 19 is positioned as desired and need not be centered between the two opposing side rails 13. Dividing rail 19 is selectively positioned between end rails 11. An additional dividing rail 19 is selectively used to divide crib 10 into three separate areas within crib 10.

With respect to the above description then, it is to be realized that the optimum dimensional relationships for the parts of the adjustably partitioned crib, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. An adjustably partitioned crib for at least two infants, the crib comprising:

a parallelepiped structure comprised of four corners and having two opposing spaced apart end rails, the end rails further comprising end rail tops, the end rail tops continuing, at each end of each top, in a downward 90 degree bend, thereby forming a vertical leg at each corner of the crib, the legs fastened to and continuing below a horizontal crib base, the end rails further comprising a plurality of vertical members attached between the end rail tops and the horizontally disposed crib base;

a bottom of each leg further comprising a caster, thereby providing increased mobility of the crib;

two spaced apart opposing side rails joining the end rails at each corner of the parallelepiped structure, each side rail further comprising a plurality of vertical members attached between a side rail top and the crib base;

a mattress horizontally and removably fitting atop the crib base;

at least one dividing rail removably positioned vertically between the two opposing side rails;

hooks on a top of each end of at least one dividing rail, the hooks removably hooking over a top of each end rail;

means for selectively and removably affixing at least one dividing rail between the two side rails whereby at least one dividing rail selectively and removably defines separated areas within the crib, the means comprising:

a member orifice in a lower region of at least one of the vertical members of each opposing end rail;

a corresponding dividing rail hole in each end vertical column of at least one dividing rail;

locating pins, each locating pin removably inserting through the member orifice of each at least one vertical member of the end rail and through the dividing rail hole of the end vertical column of each dividing rail, the locating pin comprising a head on one end and a ball detent on an opposite end, thereby securing each end vertical column to each opposing end rail;

a plurality of drawers are affixed below the crib base, more than one drawer opening outwardly and perpendicularly to a plane of the side rails and more than one drawer opening outwardly and perpendicularly to a plane of the end rails.

2. An adjustably partitioned crib for at least two infants, the crib comprising:

a parallelepiped structure comprised of four corners and having two opposing spaced apart end rails, the end rails further comprising end rail tops, the end rail tops continuing, at each end of each top, in a downward 90 degree bend, thereby forming a vertical leg at each corner of the crib, the legs fastened to and continuing below a horizontal crib base, the legs further comprising casters at a bottom end of each leg, the end rails further comprising a plurality of vertical members attached between the end rail tops and the horizontally disposed crib base;

each vertical member of each opposing end rail further comprising a member orifice in a lower region of each vertical member;

two spaced apart opposing side rails joining the end rails at each corner of the parallelepiped structure, the side rails further comprising a plurality of vertical members attached between a top of the side rail and the crib base;

a mattress horizontally and removably fitting atop the crib base;

at least one dividing rail removably positioning vertically between the two opposing side rails and atop the mattress, the at least one dividing rail further comprising hooks on a top of each of two opposite ends of at least one dividing rail, the hooks removably fitting over a top of at least one end rail;

means for selectively and removably affixing at least one dividing rail between the two side rails whereby at least one dividing rail defines separated areas within the crib, the means comprising:

a member orifice in a lower region of at least one of the vertical members of each opposing end rail;

a corresponding dividing rail hole in each end vertical column of at least one dividing rail;

locating pins, each locating pin removably inserting through the member orifice of each at least one vertical member of the end rail and through the dividing rail hole of the end vertical column of each at least one dividing rail, the locating pin comprising a head on one end and a ball detent on an opposite end, thereby securing each end vertical column to each opposing end rail;

a plurality of drawers affixed below the crib base, more than one drawer opening outwardly and perpendicularly to a plane of the side rails and more than one drawer opening outwardly and perpendicularly to a plane of the end rails.

3. An adjustably partitioned baby crib for at least two infants, the crib comprising:

a parallelepiped structure comprised of four corners and having two opposing spaced apart end rails, the end rails further comprising end rail tops, the end rail tops continuing, at each end of each top, in a downward 90 degree bend, thereby forming a vertical leg at each corner of the crib, the legs fastened to and continuing below a horizontal crib base, the legs further comprising casters at a bottom end of each leg, the end rails further comprising a plurality of vertical members attached between the end rail tops and the horizontally disposed crib base, each vertical member having a member orifice in a lower region;

two spaced apart opposing side rails joining the end rails at each corner of the parallelepiped structure, the side rails further comprising a plurality of vertical members attached between a top of the side rail and the crib base;

a mattress horizontally and removably fitting atop the crib base;

more than two dividing rails selectively and removably positioning vertically between the two opposing side rails and atop the mattress, the dividing rails further comprising hooks on a top of each of two opposite ends of each dividing rail, the hooks removably fitting over a top of each end rail, the dividing rails further comprising dividing rail holes corresponding to the member orifices of the vertical members of the end rails;

locating pins, each locating pin removably inserting through the member orifice of each vertical member of the end rail and through the dividing rail holes of the end vertical columns of each dividing rail, each locating pin comprising a head on one end and a ball detent on an opposite end, thereby securing each end vertical column to each opposing end rail;

a plurality of sliding drawers are affixed below the crib base, more than one drawer opening outwardly and perpendicularly to a plane of the side rails and more than one drawer opening outwardly and perpendicularly to a plane of the end rails.

* * * * *